US006908126B2

(12) United States Patent
Senger

(10) Patent No.: US 6,908,126 B2
(45) Date of Patent: Jun. 21, 2005

(54) ENHANCED SECURITY CATCH ASSEMBLY FOR RETAINING A HANDLE ON A SPINDLE

(75) Inventor: Christopher G. Senger, Hamden, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 10/270,999

(22) Filed: Oct. 15, 2002

(65) Prior Publication Data

US 2004/0070219 A1 Apr. 15, 2004

(51) Int. Cl.[7] ..... E05B 3/00

(52) U.S. Cl. ..... 292/348; 292/350; 70/224; 411/403; 411/404

(58) Field of Search ..... 411/402, 410, 411/424, 1, 403, 393, 404, 405; 292/348, 350; 70/224

(56) References Cited

U.S. PATENT DOCUMENTS

| | | | | | |
|---|---|---|---|---|---|
| 253,132 | A | * | 1/1882 | Towne | 292/348 |
| 253,789 | A | * | 2/1882 | Towne | 292/348 |
| 1,249,472 | A | | 12/1917 | Painter et al. | |
| 1,630,032 | A | * | 5/1927 | Rood | 292/352 |
| 1,680,112 | A | * | 8/1928 | Peterson | 292/347 |
| 1,739,710 | A | | 12/1929 | Clark | |
| 1,755,434 | A | | 4/1930 | Ellingson | |
| 2,128,144 | A | * | 8/1938 | Heinen | 292/358 |
| 2,211,130 | A | | 8/1940 | Knapp | |
| 2,473,937 | A | * | 6/1949 | Cameron | 292/348 |
| 2,701,735 | A | * | 2/1955 | Segal | 292/348 |
| 2,843,413 | A | * | 7/1958 | Martin | 292/348 |
| 2,912,846 | A | | 11/1959 | Schweitzer | |
| 2,998,274 | A | | 8/1961 | Russell | |
| 3,157,042 | A | | 11/1964 | Wolz | |
| 3,237,976 | A | * | 3/1966 | Campoli | 403/362 |
| 3,498,174 | A | * | 3/1970 | Schuster et al. | 411/5 |
| 3,708,191 | A | | 1/1973 | Hegedus | |
| 3,954,292 | A | | 5/1976 | Johnson | |
| 3,963,322 | A | * | 6/1976 | Gryctko | 439/814 |
| 4,236,396 | A | | 12/1980 | Surko, Jr. et al. | |
| 4,269,246 | A | * | 5/1981 | Larson et al. | 81/460 |
| 4,471,984 | A | * | 9/1984 | Bellantuono | 292/350 |
| 4,641,866 | A | | 2/1987 | Haeck et al. | |
| 4,641,867 | A | | 2/1987 | Geringer et al. | |
| 4,679,420 | A | * | 7/1987 | Yang | 70/422 |
| 4,869,083 | A | | 9/1989 | DeMarseilles et al. | |
| 4,884,834 | A | * | 12/1989 | Ozagir et al. | 292/350 |
| 5,265,503 | A | * | 11/1993 | Dolin | 21/176.15 |

(Continued)

FOREIGN PATENT DOCUMENTS

| | | | |
|---|---|---|---|
| FR | 1505609 | | 11/1967 |
| JP | 03-137372 | * | 3/1991 |

OTHER PUBLICATIONS

Figs. 1–7 from U.S. App. No. 09/772,268 filed on Jan. 29, 2001.

Sargent Manufacturing Company, *8Line* Parts List. pp 8.1 and 8.2.

*Primary Examiner*—Daniel P. Stodola
*Assistant Examiner*—Carlos Lugo
(74) *Attorney, Agent, or Firm*—DeLio & Peterson, LLC

(57) ABSTRACT

A catch assembly that locks a handle onto the spindle of a lock mechanism has enhanced resistance to attempts to remove the handle by forcibly driving the catch assembly inwards. The catch assembly includes a base mounted on the spindle having a threaded opening that receives a corresponding threaded retaining pin. The pin is moved axially by rotating it. When the pin is rotated to an outward position it engages the handle and the threads act to prevent the pin from being forcibly driven inward by transferring axially applied forces to the base. In the preferred design, the head of the retaining pin is softened and specially shaped to limit the torque that can be applied.

15 Claims, 2 Drawing Sheets

U.S. PATENT DOCUMENTS 5,265,924 A 11/1993 Kim
5,269,162 A 12/1993 Robida et al.
5,358,368 A * 10/1994 Conlan et al. ..... 411/410
5,421,178 A 6/1995 Hamel et al.
5,584,626 A * 12/1996 Assmundson ..... 411/6
5,688,005 A * 11/1997 Ellis ..... 292/348
5,727,406 A 3/1998 Banducci
5,857,816 A * 1/1999 Assmundson ..... 411/1
5,983,683 A 11/1999 Shen
6,101,856 A 8/2000 Pelletier et al.
6,109,851 A * 8/2000 Bauer et al. ..... 411/411
6,179,841 B1 * 1/2001 Jackson ..... 606/73
6,293,745 B1 * 9/2001 Lu ..... 411/410
6,422,049 B1 * 7/2002 Jenks ..... 70/208
6,453,781 B1 * 9/2002 Casino Lorite et al. ..... 81/460
2002/0100301 A1 * 8/2002 Eller et al. ..... 70/224
2003/0131640 A1 * 7/2003 Eller et al. ..... 70/224

* cited by examiner

ENHANCED SECURITY CATCH ASSEMBLY FOR RETAINING A HANDLE ON A SPINDLE

BACKGROUND OF THE INVENTION

1. Field of the Invention

This invention relates to devices that attach a door handle to a spindle on a lock mechanism to prevent the handle from being removed. More specifically, this invention relates to catch assemblies that prevent the handle from being removed when the lock mechanism is in the locked state and allow the handle to be removed when the lock mechanism is in the unlocked state.

2. Description of Related Art

Door locks are typically provided with a catch assembly that prevents the outer handle from being removed from the outer spindle when the door is locked. A conventional catch assembly includes a spring loaded catch oriented perpendicular to the spindle on the lock. The catch can be pressed inward when the door is unlocked to allow the base of the handle to slide over the catch and on or off the spindle. A retaining opening, such as a hole or slot to match the catch, is formed in the base of the handle perpendicular to the spindle. As the handle slides into position on the spindle, the retaining opening reaches alignment with the catch, allowing the catch to spring outward and engage the handle.

The handle cannot be removed until the catch is again pressed to the inward position. The retaining opening extends through the handle base so that the catch can be disengaged. Provided that the door is unlocked, the catch can be pressed inward against its spring pressure by inserting a tool into the retaining opening from the outside to apply inward pressure against the end of the catch.

When the door is locked, however, a lock element moves underneath the bottom end of the catch to prevent the inward motion necessary to remove the handle. This prevents the catch from being disengaged from the retaining opening in the handle base and thereby prevents the handle from being removed while the door is locked.

Although this system is quite effective, and is very widely used in bored lock designs, it is susceptible to a determined brute-force attack. The security of the catch assembly depends upon the strength of the catch and the support of the underlying lock element to prevent the catch from being driven inward. There are specialized tools available to locksmiths that can apply extreme force to the catch through the retaining opening in the handle base. The force available is sufficient to axially collapse the catch and/or crush the underlying lock element that supports the catch against inward motion. The catch is thereby forced out of engagement with the handle base, allowing the handle to be removed even though the lock mechanism remains in the locked state. Removing the handle allows access to the lock mechanism, which may permit the locked door to be opened.

Bearing in mind the problems and deficiencies of the prior art, it is therefore an object of the present invention to provide a catch assembly for retaining a handle on a spindle that provides increased resistance to brute-force attacks.

Still other objects and advantages of the invention will in part be obvious and will in part be apparent from the specification.

SUMMARY OF THE INVENTION

The above and other objects, which will be apparent to those skilled in the art, are achieved in the present invention, which is directed to a catch assembly for securing a handle to a spindle of a lock mechanism. The catch assembly engages a retaining opening in the handle and prevents the handle from being removed from the spindle except when a disengage opening in a moveable lock element is in a predetermined position relative to the catch assembly. Generally, the moveable lock element is in that position only when the lock mechanism is unlocked so that the handle cannot be removed when the lock mechanism is locked.

The catch assembly includes a base and a threaded retaining pin. The base has a threaded opening axially aligned with the retaining opening in the handle when the handle is mounted on the spindle. The retaining pin includes a head end adapted to receive a tool for rotating the retaining pin through the retaining opening, a bottom end opposite the head end, and a threaded body between the head end and the bottom end.

The diameter of the threaded body is greater than the diameter of the retaining opening through which the head end of the pin is accessed by the tool so that threaded body will not pass through the retaining opening and the pin cannot be removed through that opening. The threaded body engages the threaded opening in the base and the retaining pin moves axially between an outward position and an inward position as the tool rotates the pin. In the outward position the head end of the pin engages the handle to prevent removal of the handle. In the inward position the bottom end of the pin must extend into the disengage opening in the moveable lock element.

The retaining pin has sufficient length that the head end always engages the handle when the bottom end is not in the disengage opening. The bottom end cannot, enter the disengage opening of the moveable lock element unless the moveable lock element is in the predetermined position, which may correspond to the unlocked position for the lock mechanism, or which may be a special position reachable by rotating a key in the lock mechanism.

In the preferred embodiment of the invention, the head end of the retaining pin is a torque limiting head that limits the torque that can be applied to rotate the retaining pin. This prevents the pin from being forced out of the retaining opening by turning it in the threads of the base under a high torque. The torque may be limited by a special shape or construction for the head and/or it may be limited by the material properties of the head.

In another aspect of the invention, the head end of the retaining pin is softened. This causes the head end to mushroom out under impact or high axial forces into engagement with the retaining opening in the handle. This locks the handle onto the spindle. The softened head end may also be used to provide torque limiting alone or in combination with a special shape for the head of the pin.

The base of the catch assembly may be a separate element attached with a screw or other fastener, or it may be integrated into the spindle or another element of the lock mechanism.

BRIEF DESCRIPTION OF THE DRAWINGS

The features of the invention believed to be novel and the elements characteristic of the invention are set forth with particularity in the appended claims. The figures are for illustration purposes only and are not drawn to scale.

The invention itself, however, both as to organization and method of operation, may best be understood by reference to the detailed description which follows taken in conjunction with the accompanying drawings in which.

DESCRIPTION OF THE PREFERRED EMBODIMENT(S)

In describing the preferred embodiment of the present invention, reference will be made herein to FIGS. 1–6 of the drawings in which like numerals refer to like features of the invention.

Figure 1:
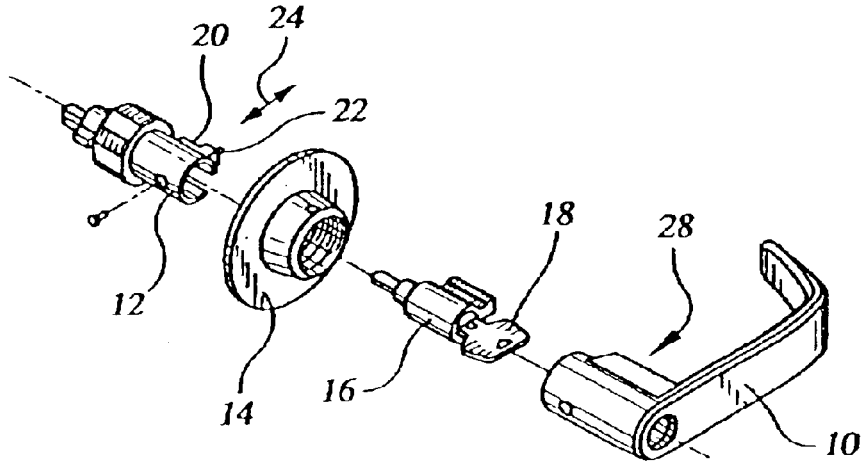
FIG. 1 is a perspective, partially exploded, view of a handle, a spindle (comprising part of a lock mechanism) and a catch mechanism according to the present invention installed on the spindle.

FIG. 1 shows a handle 10, a spindle 12, a rose 14, a lock cylinder 16 and a key 18. The specific spindle 12 that is illustrated is part of a unique high security lever handle lock mechanism of the type sold by Sargent Manufacturing Company under the trademark "11-Line," which is the subject of U.S. patent application Ser. No. 09/772,268 filed Jan. 29, 2001. However, the spindle may be any generic lock mechanism of the type that attaches a handle to a spindle.

The term "spindle" as used herein is intended to include "rollups," "sleeves," and any other type of lock mechanism element to which a handle may be connected to operate the lock mechanism.

The catch assembly of the present invention includes a base 20 and a retaining pin 22. The retaining pin 22 can move inward or outward along the line indicated by arrow 24. When the retaining pin 22 is in the outward position, it engages a retaining opening 26 in the handle 10 (see FIGS. 4 and 6) located approximately at the position indicated by reference No. 28 in FIG. 1.

The engagement between the pin 22 and the retaining opening 26 prevents the handle 10 from being removed from the spindle 12. In order to remove the handle 10 from the spindle 12 it is necessary to move the retaining pin 22 inward to disengage it from the retaining opening 26.

Figure 2:
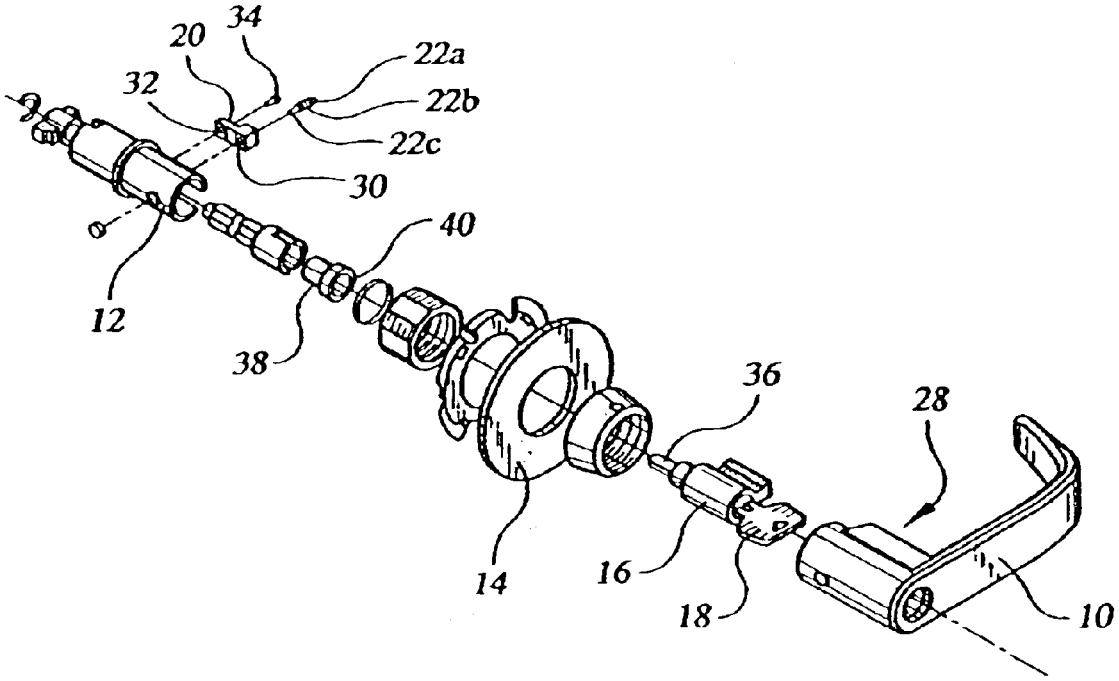
FIG. 2 is another perspective view of the handle, spindle and catch mechanism of FIG. 1 except that the items shown are more completely exploded to show component parts.

Referring to FIG. 2 it can be seen that the retaining pin 22 includes a head end 22*a*, a threaded body 22*b* and a bottom end 22*c*. The base 20 includes a threaded opening 30 that receives the retaining pin 22. The retaining pin 22 can be moved between the inward position and the outward position by rotating the head end 22*a* with a tool that extends through the retaining opening in the handle 10.

The base 20 also includes an attachment opening 32. In the design illustrated, a screw 34 extends through opening 32 and attaches the base 20 to the spindle 12. Alternatively, the base may be integrated into the spindle or some other element of the lock mechanism.

Although a specific design for a lock mechanism is shown in FIGS. 1 and 2, the invention may be used in any lock having a spindle and a removable handle. The operation of different lock mechanisms varies widely and need not be understood in detail to understand the operation of the catch assembly of the present invention and its interaction with different types of lock mechanisms. When key 18 is turned, it operates lock cylinder 16, which rotates the key tail 36. The key tail 36 rotates movable lock element 38, which includes a disengage opening 40. As lock element 38 turns, the disengage opening 40 is moved into and out of position beneath the retaining pin bottom end 22*c*.

For this invention to be implemented into another type of lock mechanism in which a handle is removed from a spindle, it is simply required that a disengage opening in a lock element be moveable into and out of position below the retaining pin. Many lock mechanisms already have a lock element of this basic type that interacts with a conventional catch.

In order for the retaining pin 22 to move to the inward position, the disengage opening 40 must be located below the pin so that the bottom end 22*c* of the pin can enter the disengage opening 40. This allows the head end 22*a* to move out of engagement with the retaining opening 26, which frees the handle.

Figure 3:
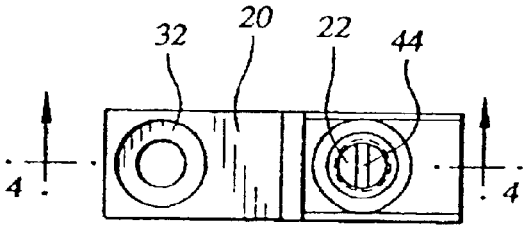
FIG. 3 is a top plan view of the catch assembly according to the present invention.
Figure 5:
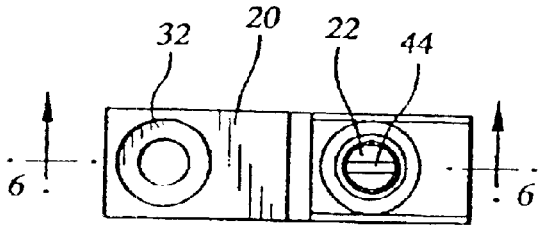
FIG. 5 is another top plan view of the catch assembly, similar to FIG. 3, except that the retaining pin is shown turned 90 degrees from the orientation in FIG. 3. The retaining pin is in the outward position, but this can be seen only in FIG. 6.
Figure 4:
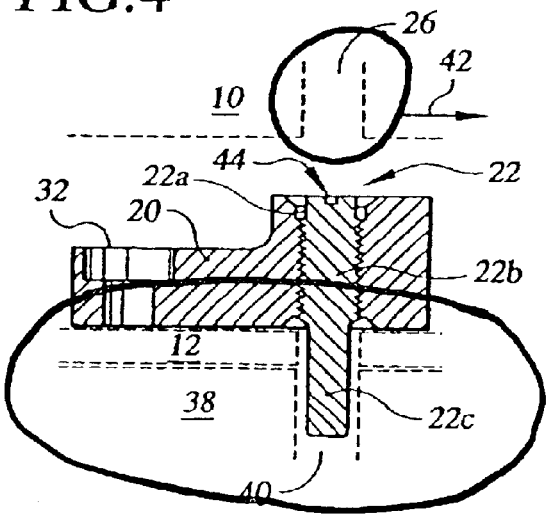
FIG. 4 is a cross-sectional view of the catch assembly of FIG. 3 taken along the line 4—4 in FIG. 3. The retaining pin is shown in the inward position, which allows the handle to be removed or installed. The relative locations of surfaces of the handle base, the retaining opening in the handle base, the movable lock element and the disengage opening in the lock element are all shown in phantom. The bottom end of the retaining pin is shown extending into the disengage opening. The disengage opening is shown in phantom in the position it reaches when the lock mechanism is unlocked.
Figure 6:
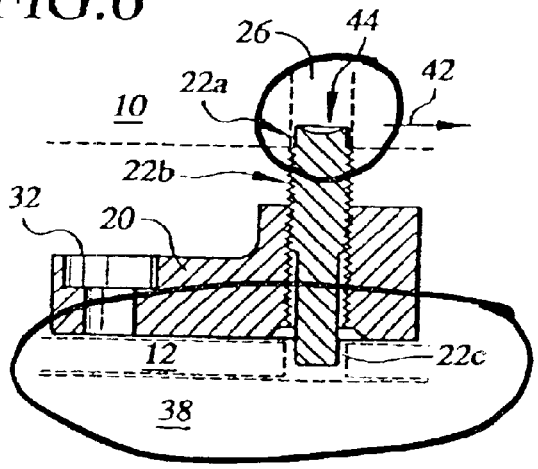
FIG. 6 is a cross-sectional view of the catch assembly, similar to FIG. 4, taken along the line 6—6 in FIG. 5. This view shows the retaining pin in the outward position with the head end of the retaining pin extending into a retaining opening in the handle, shown in phantom. The shape of the head end of the retaining pin can be seen which provides a torque limiting function. The lock mechanism has been locked in this view, which rotates the underlying lock element with the disengage opening. Accordingly, the disengage opening is not aligned with the retaining pin and cannot be seen in this view.

FIGS. 3 and 4 illustrate the catch assembly of the present invention with the retaining pin 22 in the inward position and show the lock mechanism unlocked. FIGS. 5 and 6 illustrate the catch assembly with the retaining pin 22 in the outward position and the lock mechanism locked. As can be seen in FIG. 4, with the retaining pin 22 in the inward position, the head end 22*a* is disengaged from the retaining opening 26 in the handle 10. This allows the handle 10 to slide off the spindle 12 in the direction indicated by arrow 42.

As can also be seen in FIG. 4, in order for the retaining pin 22 to move to the inward position, the disengage opening 40 in the movable lock element 38 must be axially below the retaining pin 22. This is the "predetermined position" for the movable lock element 38. The lock element 38 is in the predetermined position when the lock mechanism is unlocked or when the key 18 is inserted and the lock cylinder 16 is rotated to a special position that does not correspond to the normal locked position.

As can be seen in FIG. 6, which shows the lock element 38 in the locked position and the retaining pin 22 in the outward position, the head end 22*a* of the retaining pin 22 extends into the retaining opening 26. This prevents the handle 10 from moving in the direction indicated by arrow 42, which prevents it from being removed. As can be seen by comparing FIGS. 4 and 6, the retaining pin 22 is sufficiently long that the head end 22*a* of the retaining pin always engages the retaining opening 26 in the handle 10 when the bottom end 22*c* is not in the disengage opening 40.

Further, the bottom end 22*c* cannot enter the disengage opening 40 of the moveable lock element unless the door is unlocked, which puts the moveable lock element in the predetermined position and aligns the disengage opening 40 below the retaining pin 22.

The catch assembly of the present invention provides four distinct features that operate to prevent the retaining pin 22 from being disengaged from the retaining opening 26 in the handle 10. The first such feature resists a simple brute-force attack in which an axial force is directly applied to the head end 22*a* of the retaining pin. Such extreme forces can be generated by available locksmith tools that apply a leveraged crushing force or by impact through a hammer and punch.

The axial force is dissipated and transferred from the retaining pin to the base through the threaded engagement between them. It is substantially impossible to drive the threaded pin axially through the base without rotating it in the threads. The base is well supported by the spindle to resist such a brute force attack. No force is directly applied to the lock element 38 or the bottom end 22*c* of the pin.

In a prior art catch assembly the retaining pin slides within the base, and is not connected with threads. Thus, in such a prior art design, the applied forces must be directly resisted by the lock element 38 and by the resistance to axial compression of the bottom end 22*c* of the retaining pin. If either of these elements fail, the applied force will drive the retaining pin out of the retaining opening 26, which allows the handle to be removed. By transferring the applied force to the base through the threaded engagement with the retaining pin and from there to the spindle 12, the applied force is distributed evenly and security is improved.

A second preferred security feature of the invention is that the head end of the retaining pin 22 may be softened relative to the rest of the pin, which is preferably made of hardened steel. When a force is applied axially to the head end of the retaining pin 22, such as by striking it with a hammer through a hardened steel punch, the softened steel head of the pin 22 is sufficiently ductile that it mushrooms outward into locking engagement with the handle 10 in the retaining opening 26. This spreading action of the head end 22*a* securely attaches the retaining pin to the handle 10 and prevents the handle from being removed.

A third security feature of the invention is that the head end 22*a* of the retaining pin 22 is given a smaller diameter than the diameter of the body portion 22*b* with the threads. This prevents the retaining pin from being unscrewed out through the retaining opening 26 and removed. The body portion 22*b* is given a diameter sufficiently greater than the diameter of the retaining opening 26 that there is no tendency for the threads on the body portion 22*b* to begin to tap into the handle 10 in the retaining opening 26. The threaded length of the pin is set based on the distances of the underlying lock element 38 and the overlying handle so that the pin is captured between the handle above and the lock element below and cannot be completely unthreaded in either direction with the handle installed.

As can be seen in FIGS. 3–5, the head end 22*a* includes a slot 44 that allows the retaining pin to be turned by inserting a small flat blade screwdriver through the retaining opening 26 into engagement with the slot 44. When the screwdriver is rotated the pin 22 turns and moves between the inward position seen in FIG. 4 and the outward position seen in FIG. 6. A fourth security feature of the invention is the torque limiting head design that can be seen by examining the cross-sectional shape of the torque limiting head end 22*a* in FIG. 6.

The retaining pin in FIG. 6 is shown turned 90 degrees relative to the retaining pin in FIG. 4. As can be seen in FIG. 6, the slot 44 is not flat at the bottom, but instead, is curved upwards at the outer edges near the circumference of the pin. The bottom has a radius of curvature that automatically limits the depth that a wide flat blade screwdriver can penetrate into the slot 44. The wider the screwdriver, the shallower the entry into the slot.

The torque that can potentially be applied to a retaining pin increases as the width of the screwdriver increases and as the depth of the slot increases. With the special shape for the slot 44 shown in FIG. 6, the torque that can be applied to the retaining pin is limited to a value below the torque needed to force the pin out of opening 26 when opening 40 is not below the pin 22.

The torque limiting function is also aided by the optional softening of the steel head, as described above, which allows the head to deform when excess torque is applied. By limiting the torque that can be applied, the retaining pin 22 cannot be forcibly turned and driven down into the lock element 38 out of engagement with the handle 10.

The specific torque limiting design shown in FIGS. 3–6 for the head end of the retaining pin is only one possible design from among many designs that can provide the desired torque limiting function. For example, the head end may include a plastic insert, or a small diameter hexagonal or other shape opening may be used to limit the torque that can be applied to the pin by a tool extending through the retaining opening 26.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A catch assembly for preventing a handle from being removed from a spindle, the catch assembly comprising:

a base for attachment to the spindle, the base including a threaded opening axially aligned with a retaining opening in the handle when the handle is mounted on the spindle; and a retaining pin including:

a head end adapted to receive a tool for rotating the retaining pin through the retaining opening, a bottom end opposite the head end, and a threaded body between the head end and the bottom end, the threaded body having a diameter greater than the head end and the retaining opening to prevent the threaded body from entering the retaining opening, the diameter of the threaded body being sufficient to prevent the retaining pin from being removed through the retaining opening, the threaded body engaging the threaded opening in the base to threadedly move the retaining pin axially between an outward position wherein the head end engages the handle to prevent removal of the handle and an inward position wherein the bottom end extends into a disengage opening in a moveable lock element when the lock element is in a predetermined position relative to the catch assembly;

the retaining pin having sufficient length that the head end always engages the handle when the bottom end is not in the disengage opening of the moveable lock element and the bottom end cannot enter the disengage opening of the moveable lock element unless the moveable lock element is in the predetermined position.

2. The catch assembly of claim 1 wherein the head end of the retaining pin comprises a torque limiting head having a shape that limits the torque that can be applied to rotate the retaining pin.

3. The catch assembly of claim 2 wherein the torque limiting head comprises a curved slot.

4. The catch assembly of claim 1 wherein the head end of the retaining pin has material properties that limit the torque that can be applied to rotate the retaining pin.

5. The catch assembly of claim 4 wherein the retaining pin is metal and the head end of the retaining pin has metallurgical properties that limit the torque that can be applied to rotate the retaining pin.

6. The catch assembly of claim 5 wherein at least part of the retaining pin is hardened steel and the head end of the retaining pin is softer than the hardened steel.

7. The catch assembly of claim 4 wherein the head end of the retaining pin is softened relative to other parts of the retaining pin to limit the torque that can be applied to rotate the retaining pin.

8. The catch assembly of claim 4 wherein the head end of the retaining pin has a shape that further limits the torque that can be applied to rotate the retaining pin.

9. The catch assembly of claim 8 wherein the head end of the retaining pin has a curved slot that acts to limit the torque that can be applied.

10. The catch assembly of claim 1 wherein the head end of the retaining pin has material properties causing the head end to mushroom into engagement with the handle when the head end of the retaining pin is subjected to impact.

11. The catch assembly of claim 10 wherein the head end of the retaining pin is softened relative to other parts of the retaining pin.

12. The catch assembly of claim 11 wherein the retaining pin is steel.

13. The catch assembly of claim 1 wherein the base includes an attachment hole for receiving a screw to attach the base to the spindle.

14. A catch assembly for preventing a handle from being removed from a spindle, the catch assembly comprising:

a base for attachment to the spindle, the base including a threaded opening axially aligned with a retaining opening in the handle when the handle is mounted on the spindle; and a retaining pin including:

a head end adapted to receive a tool for rotating the retaining pin, the head end having a diameter less than the retaining opening, a bottom end opposite the head end, and a threaded body between the head end and the bottom end, the threaded body having a diameter greater than the head end and the retaining opening to prevent the threaded body from entering the retaining opening, the diameter of the threaded body being sufficient to prevent the retaining pin from being removed through the retaining opening, the threaded body engaging the threaded opening in the base to threadedly move the retaining pin axially between an outward position wherein the head end enters and engages the retaining opening in the handle to prevent removal of the handle and an inward position wherein the bottom end extends into a disengage opening in a moveable lock element when the lock element is in a predetermined position relative to the catch assembly;

the retaining pin having sufficient length that the head end always engages the retaining opening when the bottom end is not in the disengage opening of the moveable lock element and the bottom end cannot enter the disengage opening of the moveable lock element unless the moveable lock element is in the predetermined position.

15. A catch assembly for preventing a handle from being removed from a spindle, the catch assembly comprising:

a base for attachment to the spindle, the base including a threaded opening axially aligned with a retaining opening in the handle when the handle is mounted on the spindle; and a retaining pin including:

a torque limiting head end adapted to receive a tool for rotating the retaining pin with a limited torque, the head end having a diameter less than the retaining opening and material properties causing the head end to mushroom into engagement with the retaining opening when subjected to impact, a bottom end opposite the head end, and a threaded body between the head end and the bottom end, the threaded body having a diameter greater than the head end and the retaining opening to prevent the threaded body from entering the retaining opening, the diameter of the threaded body being sufficient to prevent the retaining pin from being removed through the retaining opening, the threaded body engaging the threaded opening in the base to threadedly move the retaining pin axially between an outward position wherein the head end enters and engages the retaining opening in the handle to prevent removal of the handle and an inward position wherein the bottom end extends into a disengage opening in a moveable lock element when the lock element is in a predetermined position relative to the catch assembly;

the retaining pin having sufficient length that the head end always engages the retaining opening when the bottom end is not in the disengage opening of the moveable lock element and the bottom end cannot enter the disengage opening of the moveable lock element unless the moveable lock element is in the predetermined position.

* * * * *